United States Patent [19]

Kochendorfer

[11] 4,097,096

[45] Jun. 27, 1978

[54] REFRIGERATOR HEATER TUBE GROMMET

[75] Inventor: Donald P. Kochendorfer, Dayton, Ohio

[73] Assignee: General Motors Corporation, Detroit, Mich.

[21] Appl. No.: 807,159

[22] Filed: Jun. 16, 1977

[51] Int. Cl.[2] ..... F25B 41/00

[52] U.S. Cl. ..... 312/214; 62/81; 248/27.1; 174/153 G

[58] Field of Search ..... 312/214; 62/81, 275, 62/277; 248/27.1; 174/153 G

[56] References Cited

U.S. PATENT DOCUMENTS

| | | | |
|---|---|---|---|
| 3,067,974 | 12/1962 | Baldwin | 248/27.1 |
| 3,229,939 | 1/1966 | Hubbard | 248/27.1 |
| 3,423,518 | 1/1969 | Weagant | 174/153 G |
| 3,459,628 | 8/1969 | Dixon et al. | 312/214 |
| 3,572,051 | 3/1971 | Benasutti | 62/81 |
| 3,619,482 | 11/1971 | Boor | 312/214 |
| 3,984,223 | 10/1976 | Whistler, Jr. | 62/81 |

*Primary Examiner*—Paul R. Gilliam
*Assistant Examiner*—Victor N. Sakran
*Attorney, Agent, or Firm*—Edward P. Barthel

[57] ABSTRACT

A refrigerator cabinet feed-through grommet formed of resilient material comprising an outer sleeve section having one end formed with a double flange for sealingly connecting the grommet to the cabinet liner. The grommet has an inner socket section for supporting a rigid tube, enclosing an insulated electrical heater conductor, located in the space between the cabinet outer shell and inner liner. The socket portion includes stop means for seating the tube free edge so as to obviate any contact by the electrical conductor with the end of the tube. The interconnection of the socket section with the outer sleeve section is provided by a frusto-conical shaped lead-in section being sufficiently yieldable to permit the inner socket section to move out of concentrically spaced relation with the outer sleeve section so as to compensate for some misalignment of the tube with respect to the grommet.

2 Claims, 4 Drawing Figures

REFRIGERATOR HEATER TUBE GROMMET

This invention relates to a feed-through grommet for a domestic appliance and more particularly to a combination heater tube support and electrical grommet for heater wires or the like when they pass through a refrigerator cabinet wall or the like.

In refrigerator construction there is a need to supply heat to the inner surface of the cabinet shell to prevent the condensation of moisture on the outside of the refrigerator shell near the door seals. Many refrigerator cabinets have utilized electrical resistance heaters for the application of heat to the refrigerator shell. The structure of the invention disclosed hereinafter enables electrical heater wires to be inserted inside a length of rigid metal tubing presently installed into the cabinet shell peripheral flange in a manner shown in U.S. Pat. No. 3,984,223, issued Oct. 5, 1976 to Charles C. Whistler, Jr., and assigned to the assignee of the present application. As explained in the Whistler patent, household refrigerators commonly have an outer loop of hot refrigerant gas tubing located around the cabinet shell access opening with the outer loop throughout its greater portion being located as close as possible to the outer metal shell flanges in metal-to-metal contact. Such prior art structures provide a refrigerated cabinet with efficient heat transfer by using the condensation of the hot refrigerant gas to prevent condensation of moisture adjacent the front door openings of the cabinet.

A number of problems were encountered in the substitution of electrical heat to a hot gas heated shell wherein vinyl covered electrical resistance heater wire is inserted into the metal tubing resulting in exposed lengths of the conductor wire extending from the tube free ends. For example, means were required to seal the tube ends to prevent leakage into the tubing during the foam insulating process of the cabinet to insure that the foam does not contact the exposed heater wire resulting in contamination thereof. Further, in such an assembly the insulated wire must be centered axially at the tubing outlet to prevent contact of the wire insulation with occasional rough edges or burrs inadvertently remaining at the ends of the rigid tubing.

It is accordingly an object of the present invention to provide an improved feed-through grommet for use with refrigerator cabinet rigid tubing such that electrical heating wire inserted into the tubing will be protectively sealed from foreign material such as expanded foam insulation which covers the tubing so as to completely fill the space between the refrigerator shell and inner liner.

It is another object of the present invention to provide an improved feed-through grommet in accordance with the preceding object which is sufficiently yieldable to permit portions of the grommet to move out of concentrically spaced relation with the rigid tube so as to compensate for some misalignment of the tube with respect to the grommet.

It is yet another object of the present invention to provide an improved feed-through grommet for interconnecting a rigid metallic tube located in a space between the shell and the liner for shielding an insulated electrical conductor which has an inwardly projecting rigid stop flange defining a shoulder to seat one end of the metallic tube, and wherein the stop flange has flexible centering means to define a reduced opening for centering the insulated conductor as it passes therethrough, so as to protect the conductor insulation.

Further objects and advantages of the present invention will be apparent from the following description, reference being had to the accompanying drawings, wherein a preferred embodiment of the present invention is clearly shown.

Figure 1:
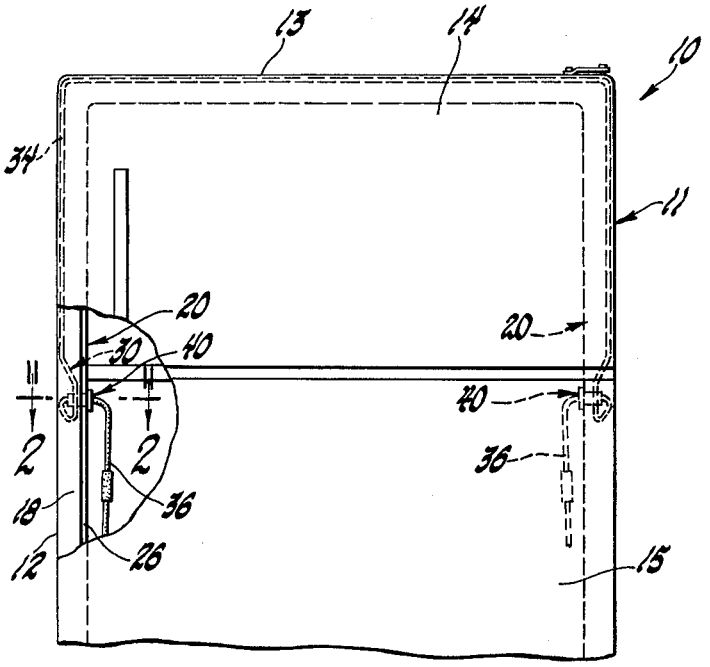
FIG. 1 is a fragmentary front elevational view of a domestic refrigerator cabinet showing a typical location of the grommet of the present invention.

Referring now to the drawings, for the purpose of illustrating the invention, there is shown in FIG. 1 thereof an insulated top freezer domestic refrigerator cabinet generally represented by the reference character 10, including a continuous outer sheet metal shell 11 forming side walls 12 and outer top wall 13. The refrigerator includes a top freezer compartment closed by upper door 14 and a bottom fresh food compartment closed by a lower door 15.

Figure 2:
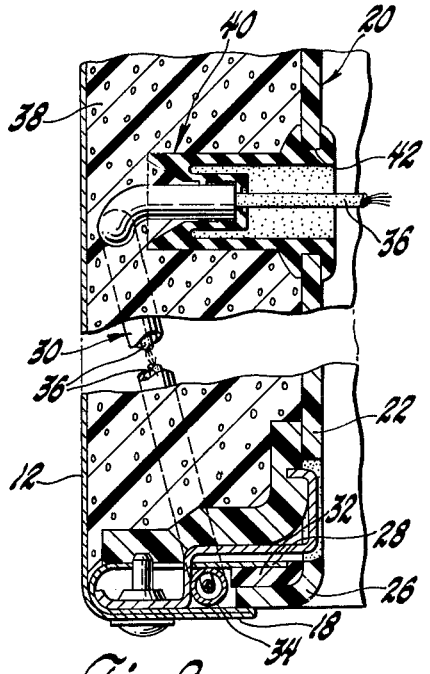
FIG. 2 is an enlarged fragmentary sectional view taken generally on the line 2—2 of FIG. 1.

As seen in FIG. 2, the cabinet shell side walls 12 are reinforced at the front with inwardly turned flanges 18 extending inwardly substantially at right angles to the side and top walls around the door opening. Preferably, this flange 18 is rounded at the corners and formed of a double thickness of metal by being folded back sharply in a manner indicated in FIG. 2. Reference may be had to the refrigerator cabinet disclosed in U.S. Pat. No. 3,572,051, to L. D. Benasutti, issued Mar. 23, 1971, assigned to the same assignee as the present application for a detailed discussion of such a construction.

As best seen in FIG. 2, the interior of the cabinet is provided with a one-piece box-shaped inner liner 20 preferably formed of a suitable sheet plastic such as acrylic butadiene styrene (ABS) copolymer having a bottom, side and top walls and rear wall. The liner side wall 22 has outturned outer flanges 26 at the front. The outturned liner flange 26 snaps into place behind the legs of the U-shaped flange arrangement 18 having its open side turned inwardly with an inner flange 28 substantially parallel to the outer flange 18.

As explained in the mentioned Benasutti patent, there is lodged tightly within this U-shaped double-flange arrangement an outer first loop of a refrigerant or metal tubing, generally indicated at 30, with the tubing having an outer diameter substantially equal to the distance between the flange 18 and 28 to establish intimate contact with the inner surface of the refrigerator shell. As explained in the mentioned Benasutti patent, there is lodged tightly within this U-shaped double flange arrangement a resilient foam plastic strip 32, preferably foamed from an open-cell polyethylene, which initially is of uniform thickness and extends slightly more than the distance between the edge of the flange 18 and the vertically extending portion 34 of the tubing loop 30. The tube 30 has extending therethrough an insulated electrical heater or conductor 36. The inner liner 20 is supported from the adjacent outer shell by expanded polyurethane foam insulation 38 which covers the tubing 30 and completely fills the space between the shell and liner. According to this invention, an improved grommet, indicated generally by the numeral 40, is provided for interconnecting the tube 30, the conductor 36 and liner 20, which conductor 36 extends through liner wall aperture 42 into the interior of the cabinet fresh food compartment.

In the preferred form the grommet 40 is formed as an integral member from suitable resilient materials such as black synthetic rubber and comprises a radially outer elongated sleeve section 44 with an axial bore 45 therein and spaced-apart exit 46 and entrance 48 open ends. An inner socket section 50, having an axial 52 for receiving the tube free end 54, includes an inner free exit end 58 positioned about midway between the sleeve ends 46 and 48.

A frusto-conical shaped tube lead-in section 60 interconnects the open entrance ends 48 and 56 of the radially outer sleeve and inner socket sections, respectively, with the other sleeve section 44 having a pair of axially spaced circumferential flanges 62 and 64 formed at the exit end 46 of the outer sleeve section 44. It will be appreciated that the flanges 62 and 64 are sized of a predetermined diameter to provide sufficient engagement with the outer and inner surfaces of the liner wall 22 around the liner opening 42 to prevent leakage of foam insulation into the cabinet.

Figure 4:
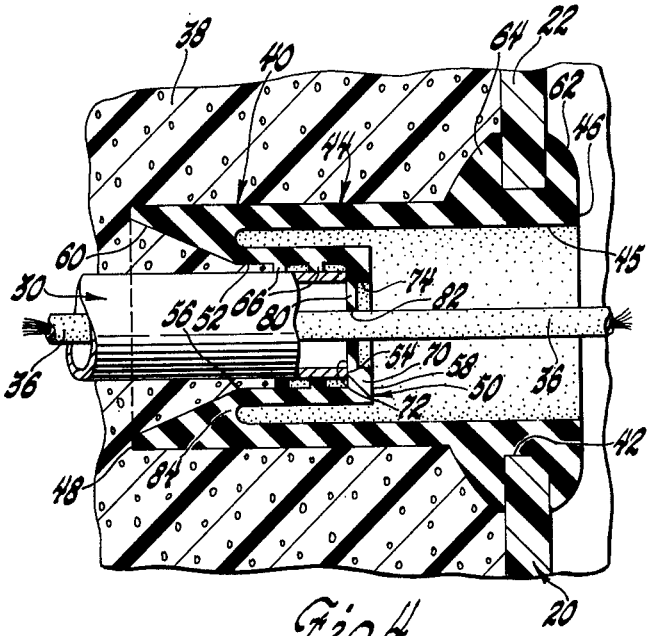
FIG. 4 is an enlarged fragmentary sectional view of the grommet showing details of its construction.

As best seen in FIG. 4, the socket section 50 is positioned by the interconnection of its entrance end 56 with the frusto-conical lead-in section 60 in concentrically spaced relation with the inner socket section intermediate the spaced-apart open ends 46 and 48 of the outer sleeve section 44. The inner surface of the socket section axial bore 52 has a plurality of axially spaced inwardly projecting concentric sealing flanges 66 sized to permit a press-fit sufficiently tight mechanical seal with the metallic tube free end 54 to prevent leakage of the foam insulation outwardly into the grommet sleeve section bore 45 during the foaming operation. The preferred embodiment uses two flanges 66.

The exit end of the socket section 50 has an inwardly projecting rigid stop flange 70 defining a circumscribing shoulder 72 seating and stopping the free end 54 of the tube. It will be noted that the tube seating arrangement does not prevent or interfere with the passage of the insulated conductor 36 into bore 45, while obviating any contact by the conductor insulation with the metal tube open end 54. The reduced counterbore 74 of the inner socket 50 includes a flexible centering means in the form of a reduced sealing ring 80 of thin section and extending inwardly therefrom to define reduced ring hole 82 of a predetermined size to insure centering of the insulated conductor 36 for axial alignment with the tube as the conductor exits therefrom. The small centering hole 82 is sized to keep the conductor 36 centered at the tubing outlet end 54 thus preventing any nicking or cutting of the conductor insulation resulting from occasional burrs at the end 54 of the metal tubing.

Figure 3:
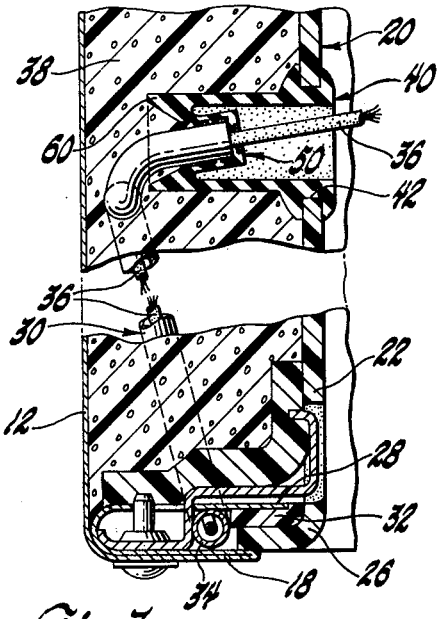
FIG. 3 is a view similar to FIG. 2, showing one form of possible misalignment of the heater support tube in relation to the grommet.

As best seen in FIG. 2, the interconnection of the socket section 50 with the frusto-conical lead-in section 60 is reduced at 84 to provide an interconnection which is sufficiently yieldable to permit the inner socket free end 58 to move out of concentrically spaced relation with the outer sleeve section bore 45 in a manner shown in FIG. 3. Thus, applicant's grommet has the capability of seating one end of the rigid tube, as shown in FIG. 4, while compensating for some misalignment of the tube with respect to the grommet.

While the embodiment of the invention as herein disclosed constitutes a preferred form, it is understood that other forms might be adopted.

I claim:

1. In a refrigerator cabinet including an outer shell and an inner liner having an opening, insulation foamed-in-place within the space between the shell and liner, and a rigid tube located in the space between the shell and liner for shielding an insulated electrical conductor, an improved grommet for interconnecting said tube, conductor and liner and for accommodating some misalignment of the tube with respect to said grommet, said grommet being formed as an integral member comprising, an outer sleeve section having spaced apart exit and entrance open ends, an inner socket section having a bore for receiving said rigid tube therein and having spaced apart exit and entrance ends, and a frusto-conical shaped rigid tube lead-in section interconnecting the entrance ends of said outer sleeve and inner socket sections, said outer sleeve section having a pair of axially spaced circumferential flanges formed at the exit end of said outer sleeve section and sized to provide sufficient engagement with the outer and inner surfaces of the liner around said liner opening to prevent leakage of the foamed insulation thereby, said socket section positioned by the interconnection of its entrance end with said lead-in section in concentrically spaced relation within said outer sleeve section, whereby said socket section is located axially intermediate the spaced apart ends of said outer sleeve section, the inner surface of said socket section having a plurality of axially spaced inwardly projecting concentric sealing flanges sized to form a press fit sufficiently tight seal with the rigid tube to prevent leakage of the foamed-in-place insulation thereby, the exit end of said socket section having an inwardly projecting rigid stop flange defining a circumscribing shoulder seating and stopping one end of the rigid tube, thereby obviating any contact by the insulated conductor with the end of the tube, said stop flange having flexible centering means extending inwardly therefrom to define a reduced opening for centering the insulated conductor as it passes therethrough, the interconnection of said socket section with said lead-in section being sufficiently yieldable to permit said inner socket section to move out of concentrically spaced relation with said outer sleeve section while seating said one end of the rigid tube so as to compensate for misalignment of the rigid tube with respect to said grommet.

2. In a refrigerator cabinet including an outer shell and an inner liner having an opening, insulation foamed-in-place within the space between the shell and liner, and a metallic tube located in the space between the shell and liner for shielding an insulated electrical conductor, an improved grommet for interconnecting said tube, conductor and liner and for accommodating some misalignment of the tube with respect to said grommet, said grommet being formed as an integral rubber-like member comprising, an outer sleeve section having spaced apart exit and entrance open ends, an inner socket section having a bore for receiving said metallic tube therein and having spaced apart exit and entrance ends, and a frusto-conical shaped metallic tube lead-in section interconnecting the entrance ends of said sleeve and inner socket sections, said outer sleeve section having a pair of axially spaced circumferential flanges formed at the exit end of said outer sleeve section and sized to provide sufficient engagement with the outer and inner surfaces of the liner around said liner opening to prevent leakage of the foamed insulation thereby, said socket section positioned by the interconnection of its entrance end with said lead-in section in concentrically spaced relation within said outer sleeve section, whereby said socket section is located axially intermediate the spaced apart ends of said outer sleeve section, the inner surface of said socket section having a pair of axially spaced inwardly projecting concentric sealing flanges sized to form a press fit hermetic seal with the metallic tube to prevent leakage of the foamed-in-place insulation thereby, the exit end of said socket section having an inwardly projecting rigid stop flange defining a circumscribing shoulder seating and stopping one end of the metallic tube, thereby obviating any contact by the insulated conductor with the end of the tube, said stop flange having flexible centering means extending inwardly therefrom to define a reduced opening for centering the insulated conductor as it passes therethrough, the inter-connection of said socket section with said lead-in section being sufficiently yieldable to permit said inner socket section to move out of concentrically spaced relation with said outer sleeve section while seating said one end of the metallic tube so as to compensate for misalignment of the metallic tube with respect to said grommet.

* * * * *